US008072347B2

(12) United States Patent
Santoso et al.

(10) Patent No.: US 8,072,347 B2
(45) Date of Patent: Dec. 6, 2011

(54) METHOD AND APPARATUS FOR LOCATING FAULTS IN WIRED DRILL PIPE

(75) Inventors: David Santoso, Sugar Land, TX (US); Dudi Rendusara, Sugar Land, TX (US); Hiroshi Nakajima, Sagamihara (JP); Kanu Chadha, San Diego, CA (US); Raghu Madhavan, Houston, TX (US); Lise Hvatum, Katy, TX (US)

(73) Assignee: Intelliserv, LLC., Houston, TX (US)

( * ) Notice: Subject to any disclaimer, the term of this patent is extended or adjusted under 35 U.S.C. 154(b) by 1376 days.

(21) Appl. No.: 11/648,139

(22) Filed: Dec. 29, 2006

(65) Prior Publication Data

US 2008/0158005 A1 Jul. 3, 2008

(51) Int. Cl.
*G01V 3/00* (2006.01)

(52) U.S. Cl. ..... 340/854.9; 340/855.2; 324/221; 324/346

(58) Field of Classification Search ..... 340/854.9, 340/855.2; 324/221, 346
See application file for complete search history.

(56) References Cited

U.S. PATENT DOCUMENTS

| | | | | |
|---|---|---|---|---|
| 3,807,502 | A | 4/1974 | Heilhecker et al. | |
| 3,957,118 | A | 5/1976 | Barry et al. | |
| 4,126,848 | A | 11/1978 | Denison | |
| 4,763,520 | A * | 8/1988 | Titchener et al. | 340/854.6 |
| 6,670,880 | B1 | 12/2003 | Hall et al. | |
| 7,096,961 | B2 | 8/2006 | Clark et al. | |
| 2002/0112852 | A1 | 8/2002 | Floerke et al. | |
| 2004/0217880 | A1 * | 11/2004 | Clark et al. | 340/854.9 |
| 2005/0046591 | A1 * | 3/2005 | Pacault et al. | 340/855.2 |
| 2005/0087368 | A1 * | 4/2005 | Boyle et al. | 175/57 |
| 2005/0212530 | A1 | 9/2005 | Hall et al. | |
| 2010/0116550 | A1 * | 5/2010 | Hutin et al. | 175/40 |

FOREIGN PATENT DOCUMENTS

GB 2 405 479 3/2005

OTHER PUBLICATIONS

UK Search Report Application No. GB0712207.0 dated Oct. 4, 2007.

* cited by examiner

*Primary Examiner* — Timothy Edwards, Jr.
(74) *Attorney, Agent, or Firm* — Conley Rose, P.C.

(57) ABSTRACT

A method for determining electrical condition of a wired drill pipe includes inducing an electromagnetic field in at least one joint of wired drill pipe. Voltages induced by electrical current flowing in at least one electrical conductor in the at least one wired drill pipe joint are detected. The electrical current is induced by the induced electromagnetic field. The electrical condition is determined from the detected voltages.

21 Claims, 6 Drawing Sheets

METHOD AND APPARATUS FOR LOCATING FAULTS IN WIRED DRILL PIPE

BACKGROUND OF THE INVENTION

1. Field of the Invention

The invention relates generally to the field of signal telemetry for equipment used in drilling wellbores through the Earth. More particularly, the invention relates to methods and apparatus for locating faults in so-called "wired" drill pipe used for such telemetry.

2. Background Art

Devices are known in the art for making measurements of various drilling parameters and physical properties of Earth formations as a wellbore is drilled through such formations. The devices are known as measurement while drilling ("MWD") for devices that measure various drilling parameters such as wellbore trajectory, stresses applied to the drill string and motion of the drill string. The devices are also known as logging while drilling ("LWD") for devices that measure various physical properties of the formations, such as electrical resistivity, natural gamma radiation emission, acoustic velocity, bulk density and others. The various MWD and LWD devices are coupled near the bottom end of a "drill string," which is an assembly of drill pipe segments and other drilling tools threadedly coupled end to end with a drill bit at the lowest end. During operation of the drill string, the drill string is suspended in the wellbore so that a portion of its weight is transferred to the drill bit, and the drill bit is rotated to drill through the Earth formations. Sensors on the various MWD and LWD devices can make the respective measurements during drilling operations. Wellbore drilling operators generally find that MWD and LWD measurements are particularly valuable when obtained during the actual drilling of the wellbore. For example, resistivity and gamma radiation measurements obtained during drilling may be compared with similar measurements made from a nearby wellbore so as to determine which Earth formations are believed to be penetrated by the wellbore at any moment in time. The wellbore operator may use such measurements to determine that the wellbore has been drilled to a particular depth necessary to conduct additional operations, such as running a casing or increasing the density of drilling fluid used in drilling operations. In general, MWD and LWD measurements may be communicated to the surface through telemetry between the bottom hole assembly and the surface. A telemetry device or tool in the bottom hole assembly with encode and transmit the data to the surface. It is often the case that the telemetry bandwidth cannot accommodate all of the MWD and LWD data that is collected. Thus, typically only a selected portion of the data is communicated to the surface, while all of the MWD and LWD data may be stored in one of the downhole components.

The signal telemetry that is most often used with MWD and LWD devices is so-called "mud pulse" telemetry. Mud pulse telemetry is generated by modulating the flow of the drilling fluid proximate the MWD or LWD devices in a manner to cause detectable changes in pressure and/or flow rate of the drilling fluid at the Earth's surface. The modulation is typically performed to represent binary digital words, using techniques such as Manchester code or phase shift keying. It is well known in the art that drilling fluid flow modulation is capable of transmitting at a rate of only a few bits per second. Thus, for most MWD and LWD applications, only a selected portion of the total amount of data being acquired is transmitted to the surface, while the data collected is stored in a recording device disposed in one or more of the MWD and LWD devices or in a another device for storing data.

Considerable effort has been made to provide a higher speed telemetry system for MWD and LWD devices. Such effort has been undertaken for a considerable time, and has resulted in a number of different approaches to high rate telemetry. For example, U.S. Pat. No. 4,126,848 issued to Denison discloses a drill string telemetry system, wherein an armored electrical cable ("wireline") is used to transmit data from near the bottom of the wellbore to an intermediate position in the drill string, and a special drill string, having an insulated electrical conductor, is used to transmit the information from the intermediate position to the Earth's surface. Similarly, U.S. Pat. No. 3,957,118 issued to Barry, et al., discloses a cable system for wellbore telemetry. U.S. Pat. No. 3,807,502 issued to Heilhecker, et al., discloses methods for installing an electrical conductor in a drill string.

More recently, alternative forms of "wired" drill pipe have been described in U.S. Pat. No. 6,670,880 issued to Hall, et al. The system disclosed in the '880 patent is for transmitting data through a string of components disposed in a wellbore. In one aspect, the system includes first and second magnetically conductive, electrically insulating elements at both ends of each drill string component. Each element includes a first U-shaped trough with a bottom, first and second sides and an opening between the two sides. Electrically conducting coils are located in each trough. An electrical conductor connects the coils in each component. In operation, a time-varying current applied to a first coil in one component generates a time-varying magnetic field in the first magnetically conductive, electrically insulating element, which time-varying magnetic field is conducted to and thereby produces a time-varying magnetic field in the second magnetically conductive, electrically insulating element of a connected component, which magnetic field thereby generates a time-varying electrical current in the second coil in the connected component.

Another wired drill pipe telemetry system is disclosed in U.S. Pat. No. 7,096,961 issued to Clark, et al., and assigned to the assignee of the present invention. A wired drill pipe telemetry system disclosed in the '961 patent includes a surface computer; and a drill string telemetry link comprising a plurality of wired drill pipes each having a telemetry section, at least one of the plurality of wired drill pipes having a diagnostic module electrically coupling the telemetry section and wherein the diagnostic module includes a line interface adapted to interface with a wired drill pipe telemetry section; a transceiver adapted to communicate signals between the wired drill pipe telemetry section and the diagnostic module; and a controller operatively connected with the transceiver and adapted to control the transceiver.

The '961 patent describes a number of issues that must be addressed for the successful implementation of a wired drill pipe ("WDP") telemetry system. For drilling operations in a typical wellbore, a large number of pipe segments are coupled end to end to form a pipe string extending from a Kelley (or top drive) located on a drilling unit at the Earth's surface and the various drilling, MWD and LWD devices in the wellbore with the drill bit at the end thereof. For example, a 15,000 ft (5472 m) wellbore will typically have about 500 drill pipe segment if each of the drill pipe segments is about 30 ft (9.14 m) long. The sheer number of pipe to pipe connections in such a WDP drill string raises concerns of reliability for the system. A commercially acceptable drilling system is expected to have a mean time between failure ("MTBF)" of about 500 hours or more. If any one of the electrical connections in the WDP drill string fails, then the entire WDP telemetry system fails. Therefore, where there are 500 WDP drill pipe segments in a 15,000 ft (5472 m) well, each WDP would have to have an MTBF of at least about 250,000 hr (28.5 yr) in order for the entire WDP system to have an MTBF of about 500 hr. This means that each WDP segment would have a failure rate of less than $4\times10^{-6}$ per hour. Such a requirement is beyond the current state of WDP technology. Therefore, it is necessary that methods are available for testing the reliability of a WDP segment and drill string and for quickly identifying any failure.

Currently, there are few tests that can be performed to ensure WDP reliability. Before the WDP segments are brought onto the drilling unit, they may be visually inspected and the pin and box connections of the pipes may be tested for electrical continuity using test boxes. It is possible that two WDP sections may pass a continuity test individually, but they might fail when they are connected together. Such failures might, for example result from debris in the connection that damages the inductive coupler. Once the WDP segments are connected (e.g., made up into "stands"), visual inspection of the pin and box connections and testing of electrical continuity using test boxes will be difficult, if not impossible, on the drilling unit. This limits the utility of such methods for WDP inspection.

In addition, the WDP telemetry link may suffer from intermittent failures that would be difficult to identify. For example, if the failure is due to shock, downhole pressure, or downhole temperature, then the faulty WDP section might recover when conditions change as drilling is stopped, or as the drill string is tripped out of the hole. This would make it extremely difficult, if not impossible, to locate the faulty WDP section.

In view of the above problems, there continues to be a need for techniques and devices for performing diagnostics on and/or for monitoring the integrity of a WDP telemetry system.

SUMMARY OF THE INVENTION

A method for determining electrical condition of a wired drill pipe according to one aspect of the invention includes inducing an electromagnetic field in at least one joint of wired drill pipe. Voltages induced by electrical current flowing in at least one electrical conductor in the at least one wired drill pipe joint are detected. The electrical current is induced by the induced electromagnetic field. The electrical condition is determined from the detected voltages.

A method for determining electrical condition of a wired drill pipe string according to another aspect of the invention includes moving an instrument along a string of wired drill pipe joints connected end to end. Electrical current is passed through a transmitter antenna on the instrument to induce an electromagnetic field in the string. Voltages induced in a receiver antenna on the instrument as a result of electrical current flowing in at least one electrical conductor in the pipe string are detected. The electrical current is induced by the induced electromagnetic field. The electrical condition between the transmitter antenna and the receiver antenna is determined from the detected voltages. The passing electrical current, detecting voltages and determining condition are then repeated at a plurality of positions along the pipe string.

A method for drilling a wellbore according to another aspect of the invention includes suspending a string of wired drill pipe joints coupled end to end in a wellbore. The pipe string has a drill bit at a distal end thereof. The drill bit is rotated while releasing the drill string from the surface to maintain a selected amount of weight on the drill bit. An electromagnetic field is induced in the pipe string at a first selected position outside the pipe string. Voltages are detected at a second selected position outside the pipe string and spaced apart from the first selected position. The voltages result from electrical current flowing in at least one electrical conductor in the pipe string. The flowing current results from the induced electromagnetic field. Electrical condition of the pipe string is determined from the detected voltages. Releasing the pipe string continues while rotating the drill bit. The inducing, detecting and determining are repeated as the pipe string is moved.

Other aspects and advantages of the invention will be apparent from the following description and the appended claims.

DETAILED DESCRIPTION

Figure 1:
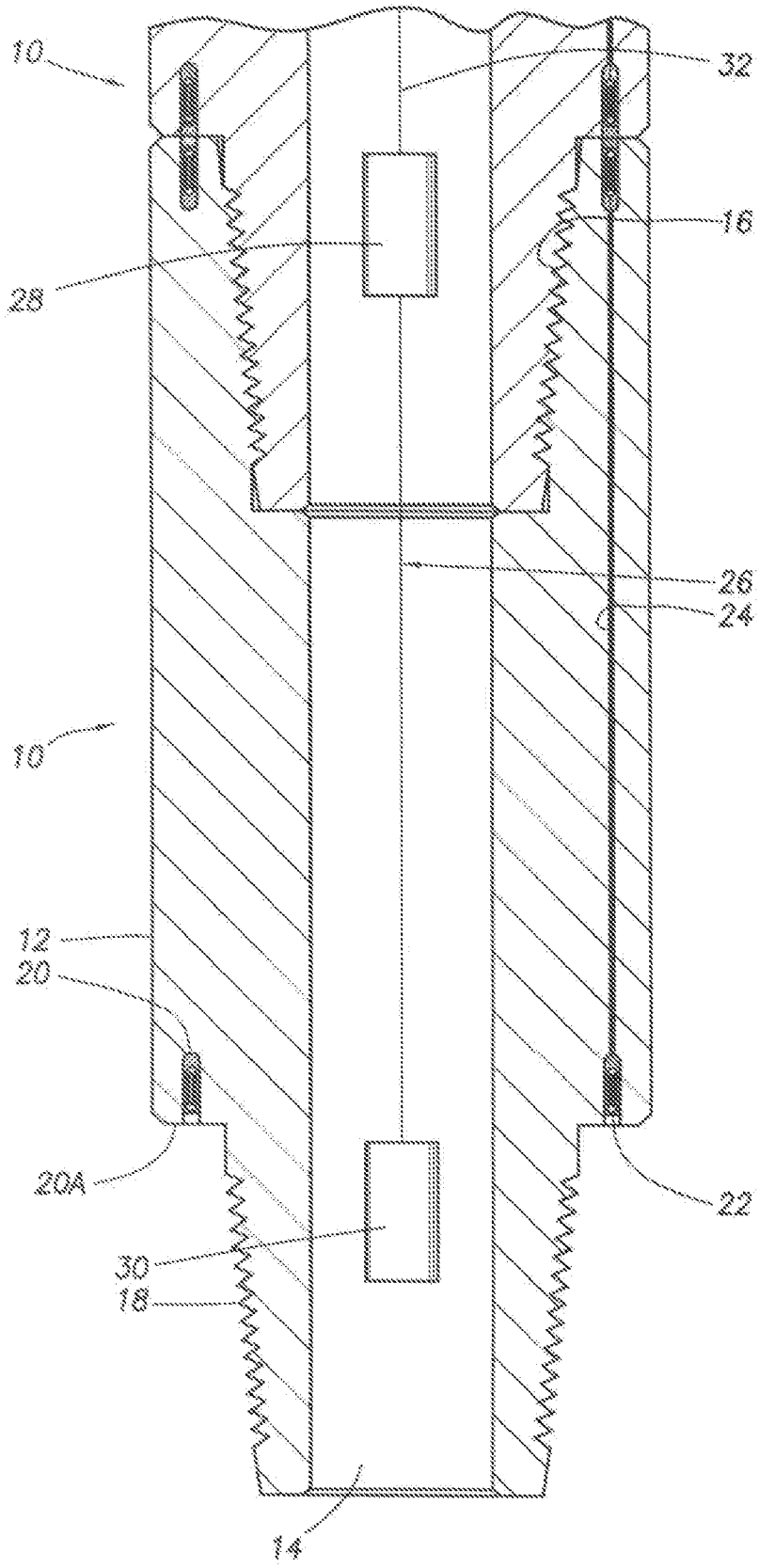
FIG. 1 shows an example of a WDP testing device as it would be used in evaluating one or more segments of WDP.

One example of a device and method for locating an electrical fault in a wired drill pipe ("WDP") telemetry system will be explained with reference to FIG. 1. Two threadedly coupled segments or "joints" of WDP are shown generally at 10. Each WDP joint 10 includes a pipe mandrel 12 having a male threaded connection ("pin") 18 at one end and a female threaded connection ("box") 16 at the other end. A shoulder 20A on each of the pin 18 and box 16 may include a groove or channel 20 in which may be disposed a toroidal transformer coil 22. Structure of and operation of such toroidal transformer coils to transfer signals from one joint to another are explained in U.S. Pat. No. 7,096,961 issued to Clark, et al., assigned to the assignee of the present invention and incorporated herein by reference. Electrical conductors 24 are disposed in a suitable place within the joint 10, such as in a longitudinally formed bore or tube (not shown) so as to protect the conductors 24 from drilling fluid that is typically pumped through a central bore or passage 14 in the center of the WDP joint 10. Such passage 14 is similar to those found in conventional (not wired) joints of drill pipe known in the art. When the pin 18 and box 16 of two WDP joints 10 are threadedly coupled, corresponding ones of the toroidal transformer coils 22 are placed proximate each other so that signals may be communicated from on joint 10 to the next joint.

In the present embodiment, a fault locating device 26 may in inserted into the passage 14 and disposed in one of the joints 10 for inspection thereof. The example fault locating device 26 is shown in FIG. 1 as being suspended inside the joint 10 by an armored electrical cable 32. The armored electrical cable may be extended from and retracted onto a winch (not shown) or similar device known in the art for spooling armored electrical cable. As will be readily appreciated by those skilled in the art, by suspending the fault locating device 26 from such a cable 32, it is possible to use the fault locating device 26 while an entire string of WDP joints 10 is deployed in a wellbore being drilled through Earth formations. Thus the entire string of WDP may be evaluated by moving the fault locating device 26 along the inside of the pipe string by operating the winch (not shown).

It should be understood that conveyance by a cable, such as shown in FIG. 1, is not the only manner in which the fault locating device 26 may be moved through WDP joints. Other conveyance means known in the art include, for example, coupling the fault locating device 26 to the end of a coiled tubing, coupling the device to the end of a string of threadedly coupled rods or production tubing, or any other manner of conveyance known in the art for deploying a measuring instrument into a wellbore.

The functional components of the fault locating device 26 shown in FIG. 1 include an electromagnetic transmitter antenna 28 and an electromagnetic receiver antenna 30. The antennas 28, 30 may be in the form of longitudinally wound wire coils, or may be any other antenna structure capable of inducing an electromagnetic field in the WDP joint 10 when electrical power is passed through the transmitter antenna 28 and capable of producing a detectable voltage in the receiver antenna 30 as a result of electromagnetic fields induced in the WDP joint 10 by the current passing through transmitter antenna 28. In the example shown in FIG. 1, circuitry (as will be explained in more detail with reference to FIG. 2) coupled to the transmitter antenna 28 causes an electromagnetic field to be induced in the WDP joint 10. The electromagnetic field induces an electric current in the circuit loop created by the electrical conductors 24 and the toroidal transformer coils 22 at each end of the WDP joint 10. Electromagnetic fields generated by such current in the circuit loop may be detected by measuring a voltage induced in the receiver antenna 30. Based on properties of the detected voltage, the electrical integrity of the WDP joint 10 may thus be determined.

One example of a fault locating device 26 will now be explained in more detail with reference to FIG. 2. The fault locating device 26 may include a pressure resistant housing 34 configured to traverse the interior of the WDP (10 in FIG. 1). The housing 34A may define a sealable interior chamber 34 in which electronic components of the fault locating device 26 may be disposed. The antennas 28, 30, which as previously explained may be longitudinally wound wire coils, may each be disposed in a respective groove or recess 28A, 30A formed in the exterior surface of the housing 34. The wire of each antenna coil 28, 30 may enter the chamber 34A by a pressure sealing, electrical feedthrough bulkhead 46. The electronic components in the present embodiment may include an electrical power conditioning circuit 48 that may accept electrical power transmitted from the Earth's surface along the cable 32 along one or more insulated electrical conductors (not shown separately). The one or more electrical conductors (not shown separately) may also be used to communicate signals produced in the fault locating device 26 to the Earth's surface. A controller 36, which may be a microprocessor-based system controller, may provide operating command signals to drive the other principal components of the device 26. For example, an analog receiver amplifier 40 may be electrically coupled to the receiver antenna 30 to detect and amplify voltages induced in the receiver antenna 30. The detected and amplified voltages may be digitized in an analog to digital converter ("ADC") 38, so that the magnitude of the voltage with respect to time will be in the form of digital words each representing the voltage magnitude. The output of the ADC 38 may be conducted to the controller 36 for storage and/or further processing. The controller 36 may store one or more current waveforms in the form of digital words. The current waveforms are those for alternating electrical current to be passed through the transmitter antenna 28. In the present embodiment, the current waveform words may be conducted through a digital to analog converter ("DAC") 42 to generate the analog current waveform. The analog current waveform may be conducted to a transmitter power amplifier 44 for driving the transmitter antenna 28.

Figure 2:
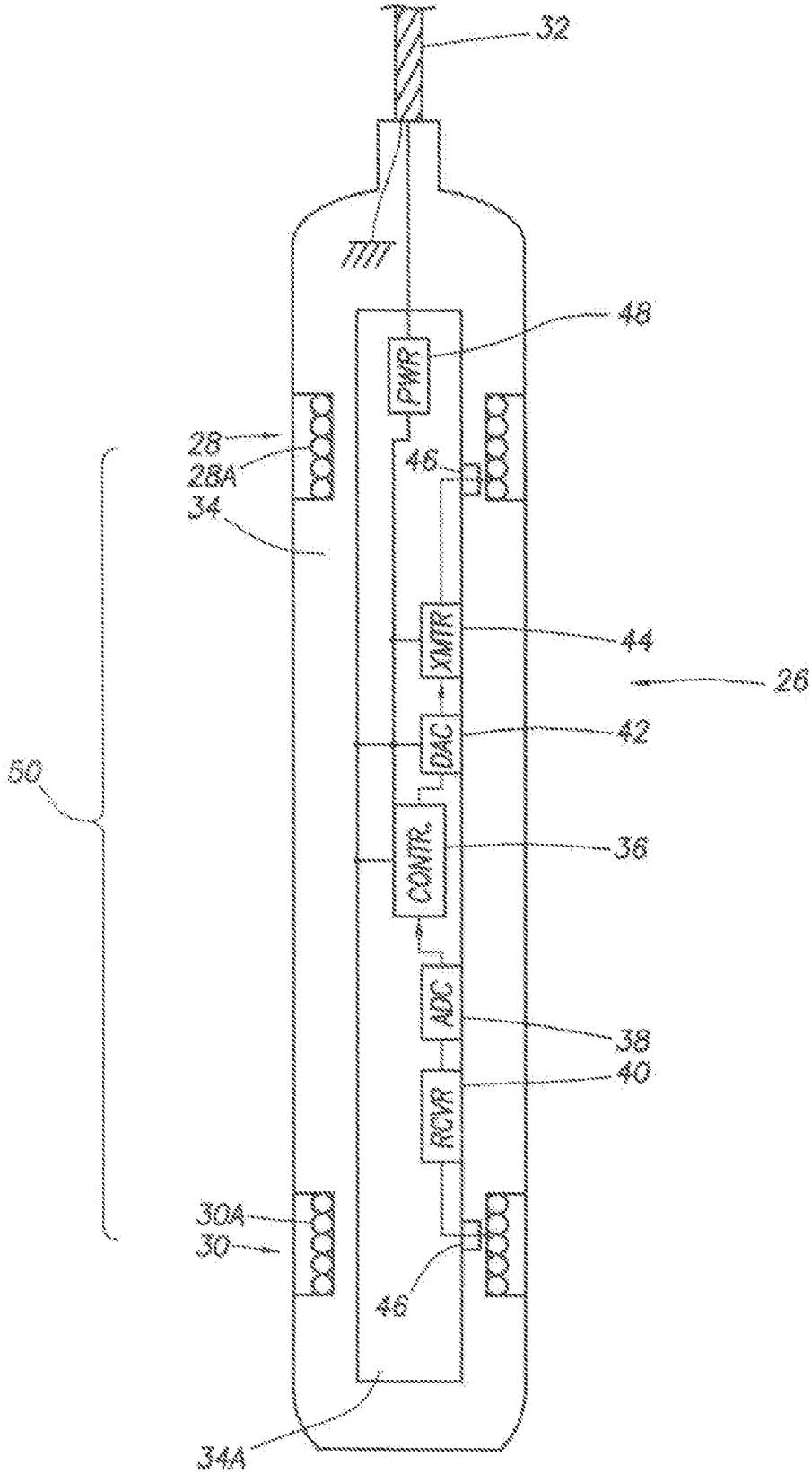
FIG. 2 shows a cross sectional view of one example of a WDP testing device.

It will be appreciated by those skilled in the art that the implementation of current generation and signal detection shown in FIG. 2, which includes digital signal processing circuitry, is only one possible implementation of a fault locating device according to the invention. It is also within the scope of this invention to use analog circuitry to generate the current and to detect the induced voltages.

In the present example, the current passing through the transmitter antenna 28 causes electromagnetic fields to be induced in the WDP joint, and specifically in the current loop created by the toroidal coils (22 in FIG. 1) and the electrical conductors (24 in FIG. 1). In an electrically sound WDP joint, a voltage will be induced in the receiver antenna 30 that corresponds to the entire current loop being properly interconnected and insulated from grounding to the metal pipe mandrel (12 in FIG. 1). The detected voltages are then digitized in the ADC 38, and are then communicated to the controller 36, where the digitized detected voltages may be imparted to any known telemetry for communication to the Earth's surface.

The example shown in FIG. 2 may have a longitudinal span 50 between the transmitter antenna 28 and the receiver antenna 30 such that antennas 28, 30 may be spaced proximate respective ones of the toroidal coils (22 in FIG. 2) in each WDP joint (10 in FIG. 1) during inspection. As the fault locating device is moved through each WDP pipe joint (10 in FIG. 1), a record is made of the voltages detected by the receiver antenna 30. If any WDP joint has an open circuit, such that the current loop described above is not complete, then the magnitude of the detected voltage will be relatively small or zero. If a WDP joint has a short circuit, the detected voltage will be small or zero when the respective antennas 28, 30 are disposed proximate the ends of the WDP joint. It will be appreciated that under such conditions it could be difficult to distinguish between an open circuit and a short circuit in the WDP joint. Therefore, other examples of a fault locating device according to the invention may have different and/or selectable span between the transmitter antenna and the receiver antenna.

Alternatively, if there is an open circuit, the detected signal would be approximately zero for the entire pipe segment being investigated. If there were a short between the conductors, however, the current would be induced in the upper part of the segment, and there would be a non-zero signal until the receiver moved past the position of the short circuit. In this respect, the detected signal could be used to identify the type of fault (short or open) and the location of the fault with in the pipe segment in the case of a short circuit.

Figure 3:
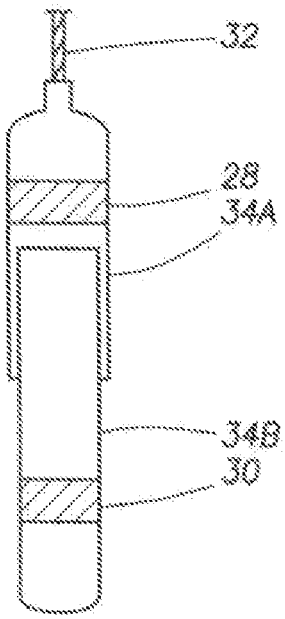
FIGS. 3 and 4 show additional examples of a WDP testing device having selectable span between transmitter and receiver.

FIG. 3 shows another possible example of a fault locating device 26A having a selectable longitudinal span between the transmitter antenna 28 and the receiver antenna 30. In the example of FIG. 3, the housing consists of two slidably engaged housing segments 34A, 34B. The transmitter antenna 28 may be formed on or affixed to one segment 34A while the receiver antenna 30 may be formed on or affixed to the other segment 30B. By sliding one segment 34B with respect to the other 34A, it is possible to change the longitudinal span between the transmitter antenna 28 and the receiver antenna 30.

Figure 4:
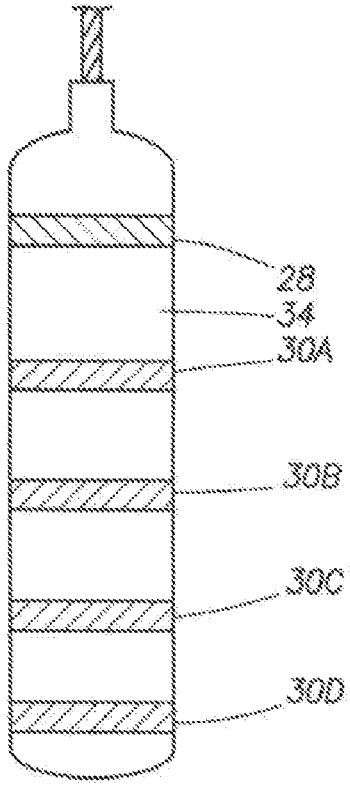

Another example of a fault locating device 26B having a selectable span between the transmitter antenna and the receiver antenna is shown in FIG. 4. In the embodiment of FIG. 4, the housing 34 may be similar to that explained with reference to FIG. 2. However, the fault locating device 26B may include a plurality of receiver antennas shown at 30A, 30B, 30C, 30D disposed on or affixed to the housing 34 at longitudinally spaced apart positions. The receiver amplifier (40 in FIG. 2) may be preceded by a multiplexer (not shown) or similar switch to select the one of the receiver antennas 30A-30D to be interrogated at any point in time. One or more of the receiver antennas 30A-30B may be used at the same time to interrogate a section of WDP. In one particular example, the transmitter to receiver span is initially set to match the span between the toroidal coils (22 in FIG. 1) in the typical WDP joint. When inspection of any one or more joints indicates low or no detected receiver voltage, then the span between the transmitter antenna 28 and the receiver antenna may be selected, as in FIG. 3 by sliding the housing segment 34B to shorten the span until a detectable voltage is found, or as shown in FIG. 4, by selecting successively shorter spaced receiver antennas 30D, 30C, 30B, 30A until a detectable voltage is found. The position of a short circuit in a WDP joint my thus be determined.

It will be appreciated by those skilled in the art that the longitudinal span (50 in FIG. 2) of the fault locating device 26 is not limited to only the span between the ends of one WDP joint as shown in FIG. 1. It is clearly within the scope of the present invention to provide a fault locating device having a span of the lengths of two or more WDP joints (10 in FIG. 1). For example, a fault locating device may have a span that is about equal to the length of three segments of WDP joints. In this manner, a fault locating device may be used to narrow the location of the fault in the WDP system. It is noted that a fault locating device with a span of two, or four or more segments is also possible.

Figure 5:
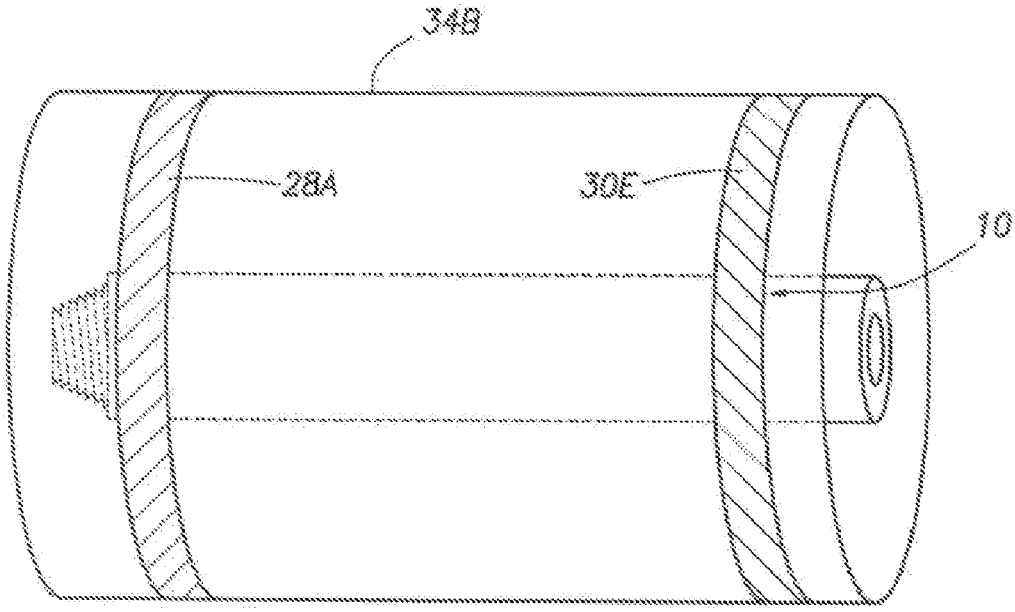
FIG. 5 shows another example of a WDP testing device that operates outside the WDP.

It is also within the scope of the present invention to determine faults in a WDP joint or joints by using a device that operates on the outside of the WDP. FIG. 5 shows another example of such a fault locating device 26C. A mandrel 34B, which in the present embodiment may be made from electrically non-conductive, non magnetic material such as glass fiber reinforced plastic, may include a transmitter antenna 28A and receiver antenna 30B which may be longitudinally wound wire coils substantially as explained with reference to FIG. 2. Not shown in FIG. 5 is the circuitry to actuate the transmitter antenna 28B and receiver antenna 30B, which also may be substantially as explained with reference to FIG. 2. The embodiment shown in FIG. 5 may have particular application on or near the floor of a drilling unit, such that as the WDP string is assembled or "made up" and is lowered into the wellbore, the individual joints of WDP will pass through the device shown in FIG. 5 for inspection during the "trip" into the wellbore. The WDP joints may be inspected again as the WDP string is withdrawn from the wellbore. Variations on the device shown in FIG. 5 that include features for changing the longitudinal span (50 in FIG. 2) between the transmitter antenna 28B and the receiver antenna 30B may be also used with the example fault locating device 26C shown in FIG. 5.

Figure 6:
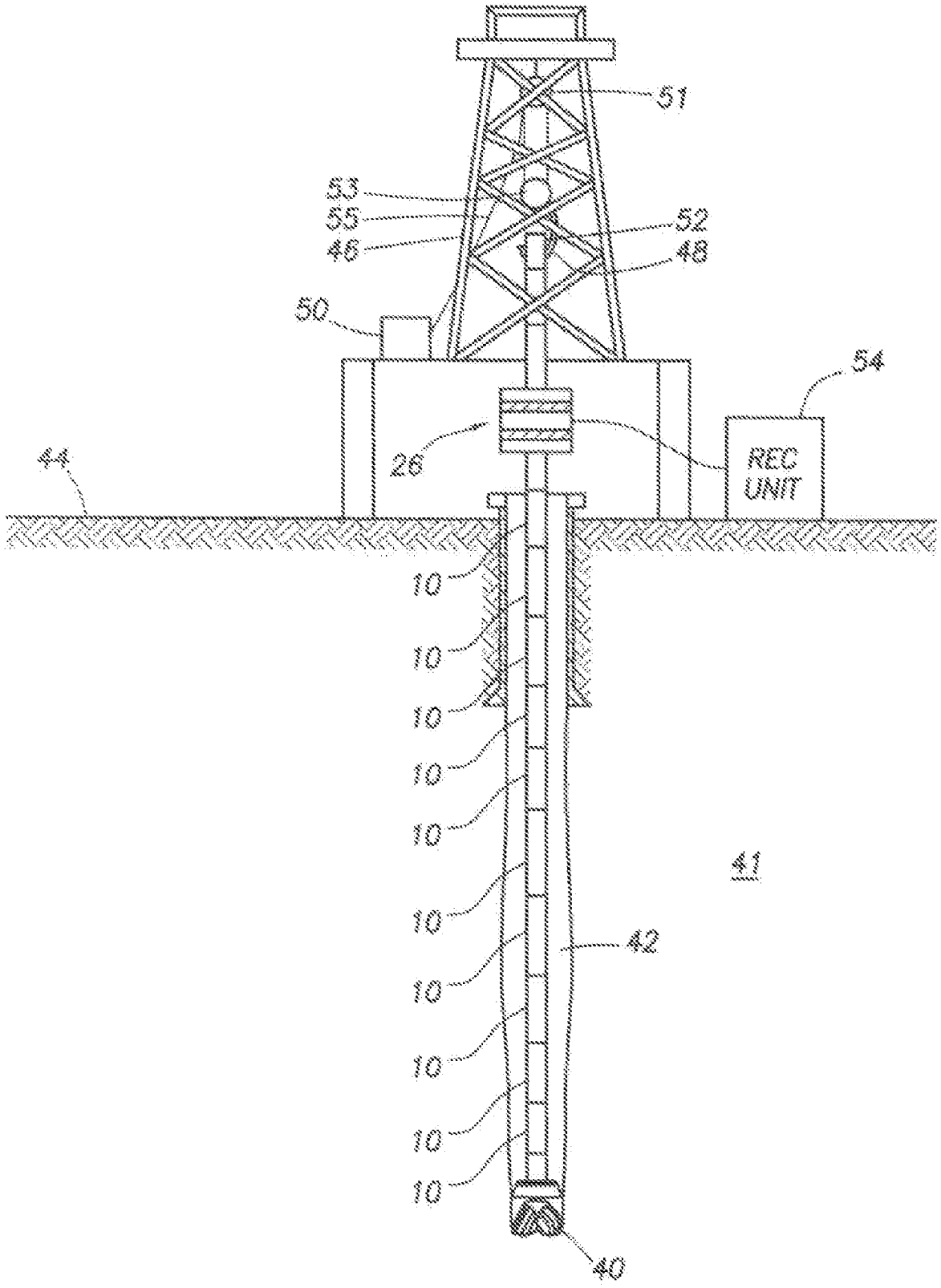
FIG. 6 shows the example device shown in FIG. 5 as it may be used with a drilling rig.

Referring to FIG. 6, the manner in which the embodiment shown in FIG. 5 may be used as explained above will be explained in more detail. A string of WDP joints 10 coupled end to end is shown suspended by a top drive 52 (or kelly on drilling units so equipped). The top drive 52 may be raised and lowered by a hook 48 coupled to a hoisting system consisting of drawworks 50, drill line 55, upper sheave 51 and lower sheave 53 of types well known in the art. All the foregoing components are associated with a drilling unit 46. A fault locating device 26 substantially as explained with reference to FIG. 5 may be disposed in a convenient location with respect to the drilling unit 46, such that as the pipe string is moved upwardly or downwardly, the various WDP joints 10 may move through the device 26 for evaluation.

A drill bit 40 is disposed at the lower end of the string of WDP joints 10 and drills a wellbore 42 through subterranean Earth formations 41. The drill bit 40 is rotated by operating the top drive 52 to turn the pipe string, or alternatively by pumping fluid through a drilling motor (not shown) typically located in the pipe string near the drill bit 40. As the drill bit 40 drills formations 41 the pipe string is continuously lowered by operating the drawworks 50 to release the drill line 55. Such operation maintains a selected portion of the weight of the pipe string on the drill bit 40. As the pipe string moves correspondingly, successive ones of the WDP joints 10 move through the interior of the fault locating device 26C. Once inside, the transmitter and receiver antenna may be activated to interrogate the WDP section that is disposed within the fault locating device 26C.

The evaluation may continue as the pipe string is withdrawn from the wellbore 42. Circuitry such as explained with reference to FIG. 2 may be disposed in a recording unit 54, which may include other systems (not shown) for recording an interpretation of measurements made by the fault locating device 26.

During drilling operations as shown in FIG. 6, if the WDP telemetry fails, in one example, a device such as shown in FIG. 2 may be lowered inside the pipe string at the end of an electrical cable, substantially as explained with reference to FIGS. 1 and 2. By using a device as shown in FIG. 2 and as explained above inside the pipe string while it is suspended in the wellbore 42, it may be possible to locate the particular WDP joint 10 where the fault is located. Such location may eliminate the need to remove the entire pipe string from the wellbore 42 and test each WDP joint 10 individually. Alternatively, the fault locating device 26 shown in FIG. 6 may be used while withdrawing the pipe string from the wellbore 42 until the failed WDP joint 10 is located.

Figure 7:
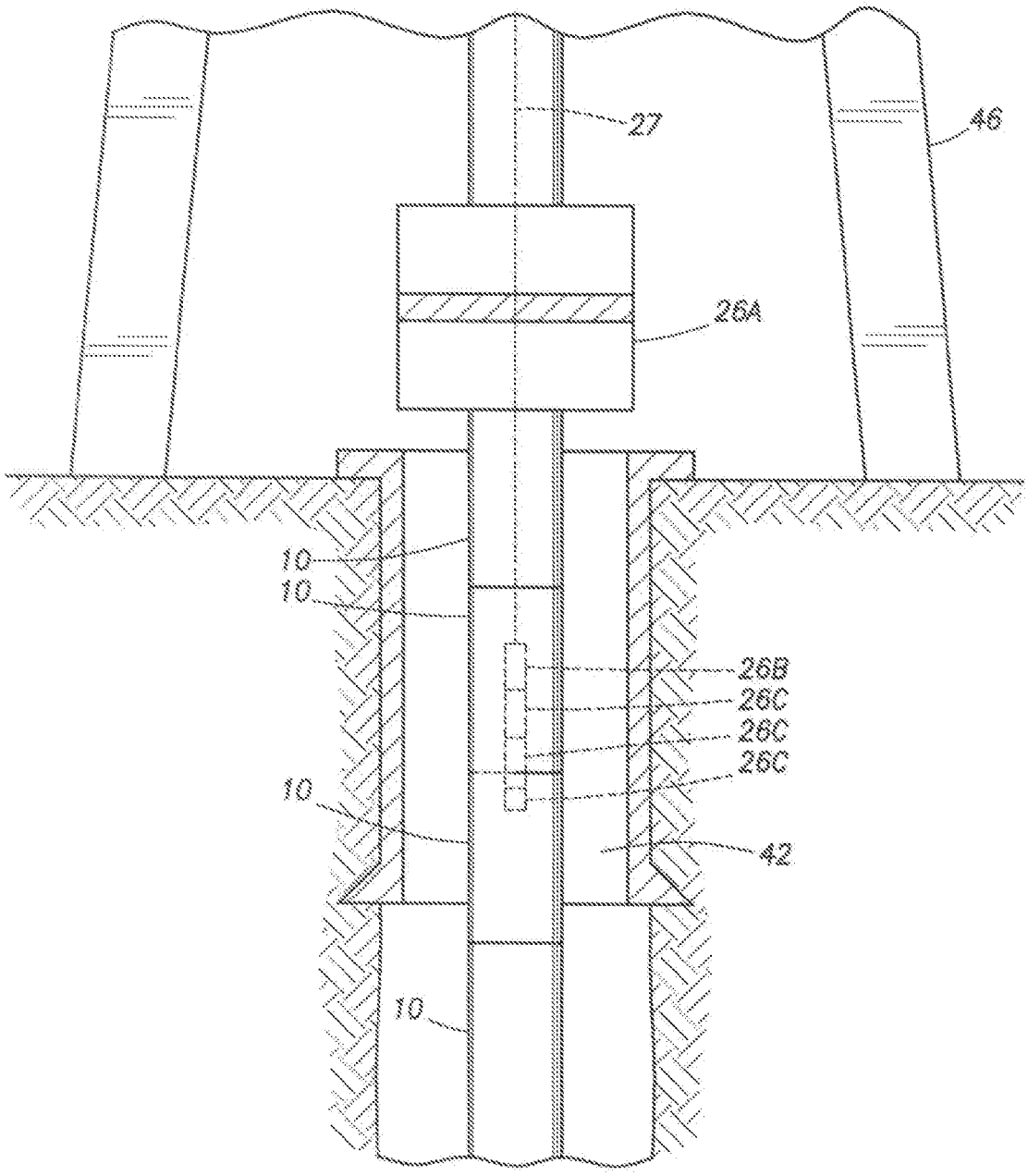
FIG. 7 shows another example fault locating device including an external transmitter coil and a movable receiver coil insertable inside the WDP.

Another example fault locating device is shown in FIG. 7. The example device shown in FIG. 7 includes a transmitter 26A similar to the example shown in and explained with reference to FIG. 6. Such transmitter 26A may be disposed below the drill floor of the drilling unit (or any other convenience location) and may be disposed outside the WDP joints 10. A receiver 26B may include one or more receiver coils 26C disposed on a sonde mandrel. The receiver 26B may be moved along the interior of the WDP joints 10 by an armored electrical cable 27 coupled to one end of the receiver 26B. During operation of the device shown in FIG. 7, the transmitter may be energized as explained above with reference to other example devices, and a record with respect to depth of voltage induced in the one or more receiver coils 26C may be made. The position of a fault such as an open or short circuit may be inferred from the record of voltage measurements.

Figure 8:
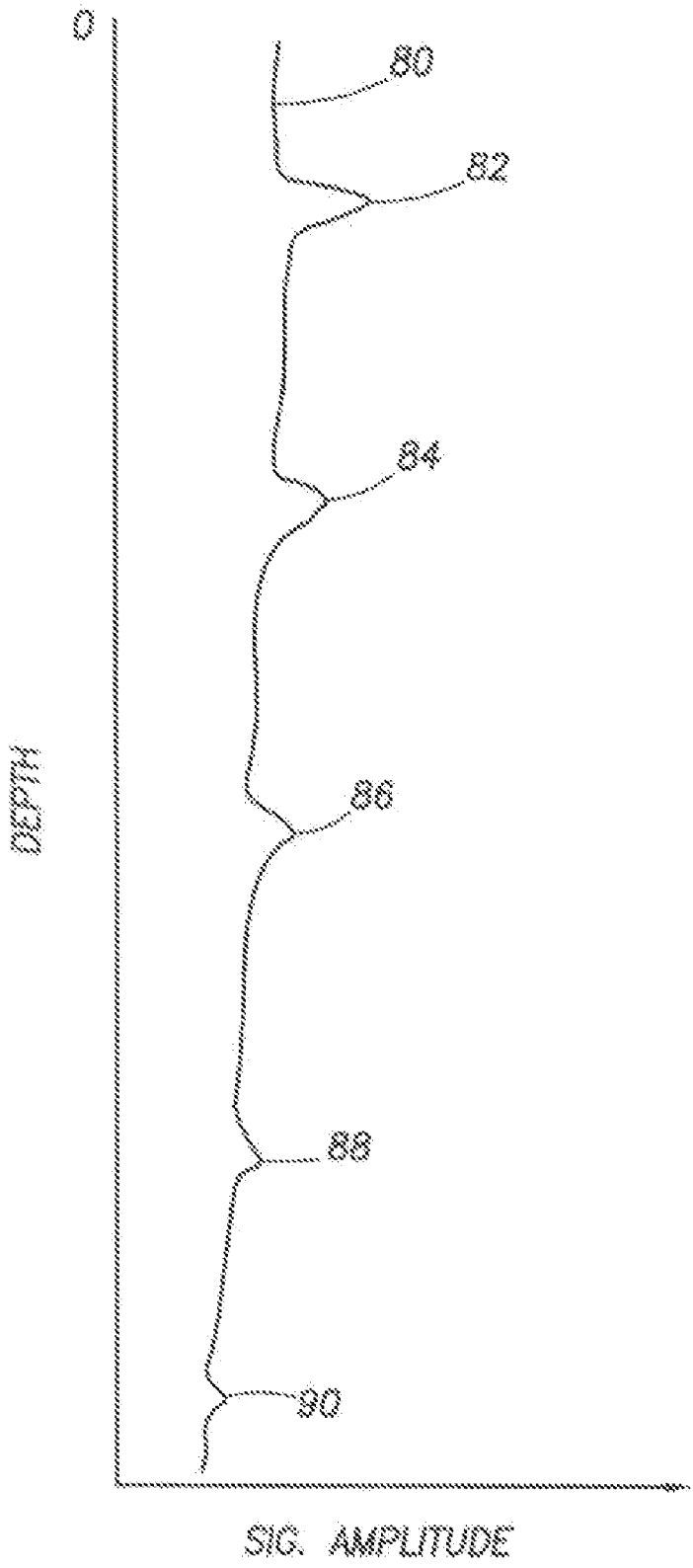
FIG. 8 shows an example record with respect to depth in a wellbore of signals measured using the example shown in FIG. 7.

A possible interpretation of signals measured by the example shown in FIG. 7 will now be explained with reference to FIG. 8. FIG. 8 is a graph (or "log") at 80 of detected voltage with respect to depth in the wellbore of the receiver (26B in FIG. 7). The detected voltage amplitude 80 exhibits peaks 82, 84, 86, 88, 90 of decreasing amplitude that correspond to the location along the WDP of connections between successive WDP joints (10 in FIG. 7). It can also be observed in FIG. 8 that the amplitude of the signal decreases with depth, and correspondingly, as the transmitter (26A in FIG. 7) and receiver (26B in FIG. 7) become more spaced apart. In one example, a log may be made of the receiver signal when drilling the wellbore begins. A log may be made of the receiver signal at selected times during drilling operations. Changes in the signal amplitude between successive logs above a selected threshold may indicate an impending fault in the WDP that requires intervention.

Any of the foregoing examples intended to be moved through the interior of a string of WDP may have electrical power supplied thereto by an armored electrical cable, or may include internal electrical power such as may be supplied by batteries. Alternatively, such devices may be powered by a fluid operated turbine/generator combination as will be familiar to those skilled in he art as being used with MWD and/or LWD instrumentation. Such examples may include internal data storage that can be interrogated when he device is withdrawn from the interior of the WDP, or signals generated by the device may be communicated over the armored electrical cable where such cable is used.

It will also be appreciated by those skilled in the art that multiple receiver antenna example such as shown in FIG. 4 may be substituted by multiple transmitter antennas each or selectively coupled to the source of alternating current. The example explained with reference to FIG. 7 may also be substituted by a receiver in the position where the transmitter is shown below the rig floor, and the receiver inside the WDP may be substituted by one or more transmitters. Such possibility will occur to those of ordinary skill in the art by reason of the principle of reciprocity. Therefore, reference to "transmitter", "transmitting" or "transmitter antenna" in the description and claims that follow may be substituted by "receiver", "receiving" or "receiver antenna" where such reference defines location of a particular antenna or act performed through an antenna. The opposite substitution may be made with reference herein to "receiver", "receiving" or "receiver antenna."

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for determining an electrical condition of a wired drill pipe, comprising:

inducing an electromagnetic field in at least one joint of wired drill pipe via a transmitter antenna configured to move relative to and over the length of the at least one joint of drill pipe;

detecting a voltage induced by electrical current flowing in at least one electrical conductor in the wired drill pipe, the electrical current induced by the induced electromagnetic field; and determining the electrical condition from the detected voltages.

2. The method of claim 1, wherein the wired drill pipe comprises a wired drill pipe segment.

3. The method of claim 1, wherein the wired drill pipe comprises a plurality of interconnected wired drill pipe segments.

4. The method of claim 1 wherein the inducing the electromagnetic field is performed proximate one end of the pipe joint and the detecting is performed proximate the other end of the pipe joint.

5. The method of claim 1 wherein detecting a voltage comprises detecting voltages induced by the flowing electrical current in a plurality of electrical conductors at a plurality of locations along the length of the wired drill pipe.

6. The method of claim 1 wherein the inducing the electromagnetic field and the detecting are performed from within a central bore of the pipe joint.

7. The method of claims 1 wherein the inducing the electromagnetic field and the detecting are performed outside a drill string comprising the pipe.

8. The method of claim 1 wherein the inducing the electromagnetic field comprises passing alternating electrical current through a transmitter antenna.

9. The method of claim 1 wherein the detecting voltage comprises measuring a voltage existing on a receiver antenna.

10. The method of claim 1 further comprising locating a position of a fault along the at least one joint by changing a position along the pipe joint where the detecting is performed while substantially maintaining a position where the inducing is performed.

11. A method for determining electrical condition of a wired drill pipe string, comprising:

moving an instrument along a string of wired drill pipe joints connected end to end;

passing electrical current through a transmitter antenna on the instrument to induce an electromagnetic field in the string;

detecting voltages induced in a receiver antenna on the instrument as a result of electrical current flowing in at least one electrical conductor in the pipe string, the flowing electrical current induced by the induced electromagnetic field;

determining the electrical condition between the transmitter antenna and the receiver antenna from the detected voltages; and repeating the passing electrical current, detecting voltages and determining condition at a plurality of positions along the pipe string.

12. The method of claim 11 wherein at least one of the inducing the electromagnetic field and the detecting are performed from within the pipe joint.

13. The method of claims 11 wherein at least one of the inducing the electromagnetic field and the detecting are performed outside the pipe.

14. The method of claim 11 further comprising changing a longitudinal distance between the transmitter antenna and the receiver antenna to locate an electrical fault.

15. The method of claim 14 wherein the changing longitudinal distance comprises moving at least one of the transmitter antenna and the receiver antenna along the interior of the pipe string.

16. The method of claim 15 further comprising repeating the moving the instrument, passing electrical current, detecting voltages, determining electrical condition and moving along the interior at selected times to anticipate an electrical fault in the pipe string.

17. The method of claim 11 wherein the changing longitudinal distance comprises changing a length of the instrument.

18. The method of claim 11 wherein the changing longitudinal distance comprises at least one of:

selecting a particular receiver antenna from a plurality of receiver antennas disposed on the instrument at spaced apart positions and selecting a particular transmitter from a plurality of transmitter antennas disposed on the instrument at spaced apart positions.

19. A method for drilling a wellbore, comprising:

suspending a string of wired drill pipe joints coupled end to end in a wellbore, the string having a drill bit at a lower end thereof;

rotating the drill bit while releasing the drill string from the surface to maintain a selected amount of weight on the drill bit;

inducing an electromagnetic field at a first selected position outside the pipe string;

detecting voltages at a second selected position outside the pipe string and spaced apart from the first selected position, the voltages resulting from electrical current flowing in at least one electrical conductor in the pipe string, the flowing current resulting from the induced electromagnetic field;

determining electrical condition of the pipe string from the detected voltages;

continuing releasing the pipe string while rotating the drill bit; and repeating the inducing, detecting and determining.

20. The method of claim 19 wherein the inducing the electromagnetic field comprises passing alternating electrical current through at least one transmitter antenna.

21. The method of claim 19 wherein the detecting voltages comprises measuring voltage existing on at least one receiver antenna.

* * * * *